United States Patent [19]

Zijlstra

[11] 4,186,770

[45] Feb. 5, 1980

[54] WASH-HOUSE FITTING INCLUDING A TROUGH

[75] Inventor: Jan G. H. Zijlstra, Auckland, New Zealand

[73] Assignee: AHI Operations Limited, Auckland, New Zealand

[21] Appl. No.: 740,345

[22] Filed: Nov. 9, 1976

[30] Foreign Application Priority Data

Nov. 19, 1975 [NL] Netherlands ..... 179293

[51] Int. Cl.[2] ..... E03C 1/01

[52] U.S. Cl. ..... 137/572; 68/DIG. 2

[58] Field of Search ..... 137/571, 572; 68/DIG. 2

[56] References Cited

U.S. PATENT DOCUMENTS

| | | | |
|---|---|---|---|
| 2,287,927 | 6/1942 | Altorfer | 68/DIG. 2 |
| 2,884,947 | 5/1959 | Gerhardt | 68/DIG. 2 |

FOREIGN PATENT DOCUMENTS

| | | | |
|---|---|---|---|
| 163678 | 6/1955 | Australia | 68/DIG. 2 |
| 582268 | 9/1959 | Canada | 68/DIG. 2 |
| 693407 | 9/1964 | Canada | 68/DIG. 2 |
| 957580 | 5/1964 | United Kingdom | 68/DIG. 2 |

*Primary Examiner*—William R. Cline
*Assistant Examiner*—H. Jay Spiegel
*Attorney, Agent, or Firm*—Ladas, Parry, Von Gehr, Goldsmith & Deschamps

[57] ABSTRACT

A wash-house fitting including a trough which is able to be combined with a washing appliance preferably a washing machine. A pair of pipes run between the trough and the washing appliance, one of these pipes being arranged such that water, such as soapy water, initially in the washing appliance can be passed through that pipe to the trough through an aperture in the base or walls of the trough for later return to the washing appliance. The other pipe is arranged such that another liquid such as rinse water may be transferred from the washing appliance to a drainage system.

6 Claims, 2 Drawing Figures

WASH-HOUSE FITTING INCLUDING A TROUGH

This invention relates to a wash-house fitting including a trough.

Where wash-house appliances are being used, for example, washing machines and in particular automatic washing machines it is often desirable to discharge the washing water into the trough or tub so that the drainage pipes of the trough or tub can be utilised for the discharge of water from the washing machine.

The rinse water is usually discharged after each rinse but particular where the water supply is limited it is often desirable for the washing or soapy water to be retained and re-used.

In the circumstances it is desirable that the trough be used as a holding tank such that the soapy water can be held while, for example, the washing is being rinsed and then once the rinse water has been discharged and the clothes removed the soapy water can then be replaced into the washing machine.

Hitherto in order that such arrangements can be used, it has been necessary to take the discharge, particularly of the soapy water, from the washing machine and lead it by means of pipes or hoses over the lip of the trough so that the water can be discharged into the trough.

These arrangements are not desirable in particular as the resulting entanglement of pipes or hoses is, to say the least, unaesthetic.

It is therefore an object of the present invention to provide a wash-house fitting including a trough which will go at least some way towards meeting the foregoing desiderata and obviating or minimising the foregoing disadvantages in a simple yet effective manner or which will at least provide the public with a useful choice.

To those skilled in the art to which this invention relates, many changes in construction and widely differing embodiments and applications of the invention will suggest themselves without departing from the scope of the invention as defined in the appended claims. The disclosures and the description herein are purely illustrative and are not intended to be in any sense limiting.

Figure 1:
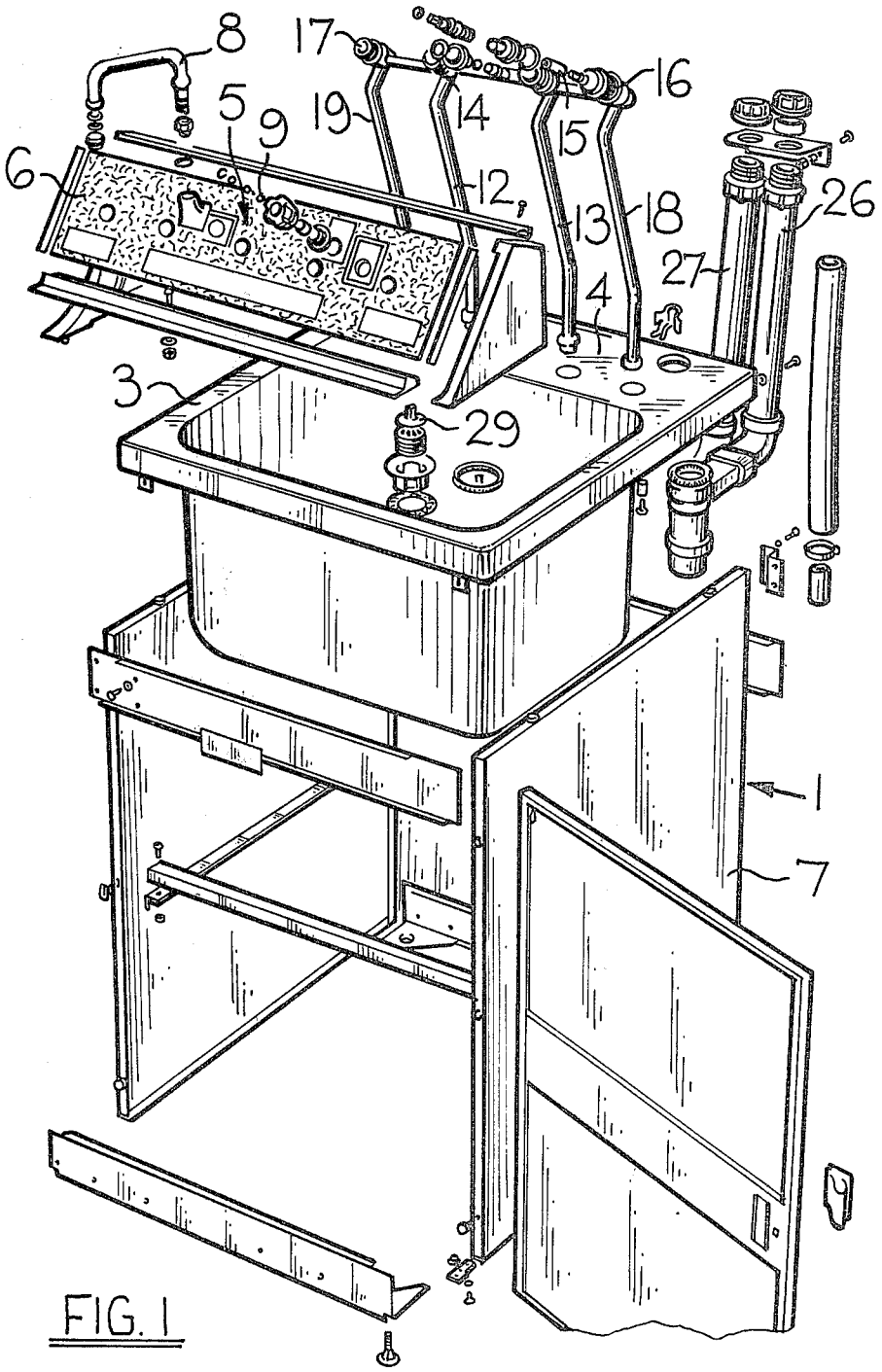
Figure 2:
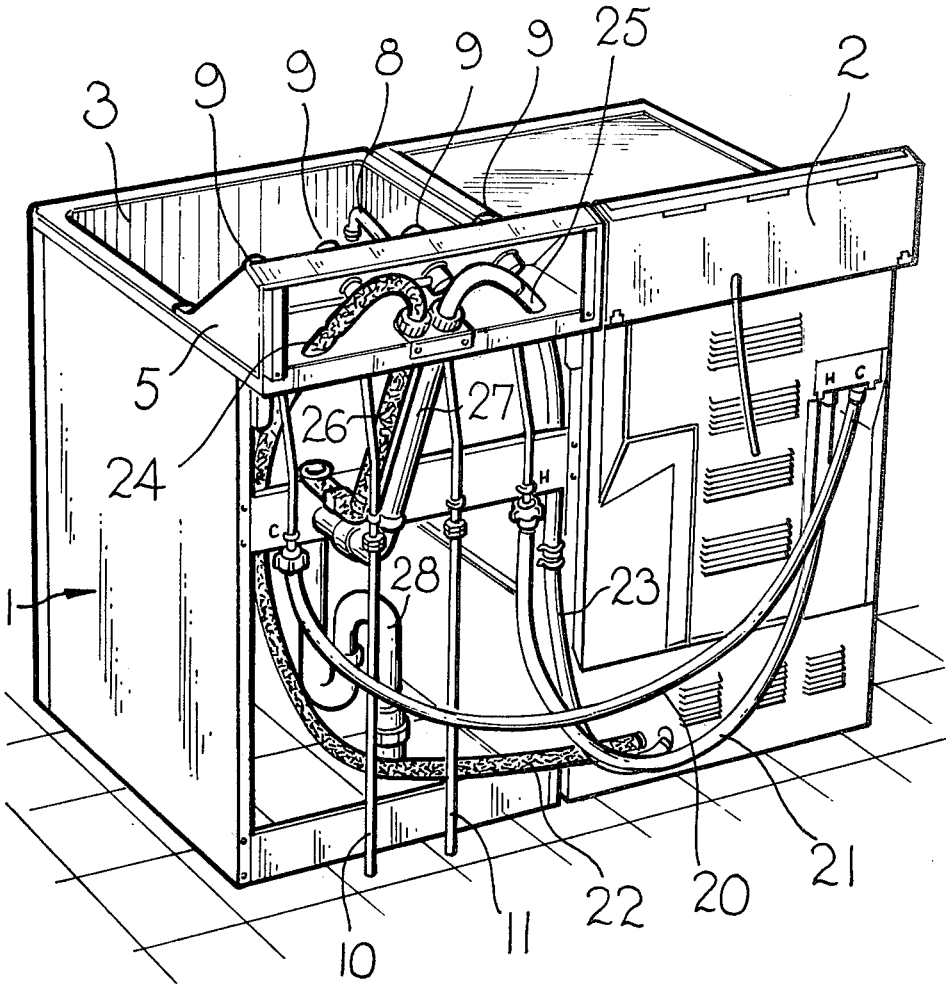

One preferred form of the invention will now be described with reference to the accompanying drawings in which FIG. 1 is an exploded perspective view of a wash-house fitting of a type particularly suitable for use in the invention and, FIG. 2 is a rear view of a wash-house fitting such as shown in FIG. 1 and a washing machine in combination according to the invention.

In the preferred form of the invention a wash-house fitting 1 and washing appliance, such as a washing machine such as an automatic washing machine 2 are provided.

The fitting 1 includes a trough or tub 3 which trough 3 is extended at the rear thereof by a plate 4 onto which is mounted a housing 5.

The front plate 6 of the housing is preferably coloured and is designed so as to provide a matching appearance to the equivalent parts of the washing machine 2 and thus the appearance of the plate 6 may change.

A cabinet 7 provided below the trough 3 which is preferably also sized and coloured so as to substantially match the appearance of the washing machine 2 so as to provide aesthetic appeal in the laundry in which the wash-house fitting and washing machine are installed.

The fitting may include a faucet 8 and a number of control handles 9 of which only one is shown in FIG. 1. Inlet pipes 10 and 11 are provided for the cold and hot water and the inlet pipes 10 and 11 may engage pipes 12 and 13 which lead to valves 14 and 15 which control the flow of water to the faucet 8. Valves 16 and 17 are also provided which control the fluid flow to pipes 18 and 19 and thence to pipe 20 and 21 so that hot and cold water can be supplied to the washing machine by operating the control valves 16 and 17.

A pair of pipes i.e. first pipe 22 and second pipe 23 are provided between the wash-house fitting 1 and the washing machine 2.

The pipe 22 is provided to allow a first liquid which comprises generally soapy water used for washing clothes or the like within the washing machine and the pipe 23 is provided to discharge the rinse water used in the washing process.

The pipes 22 and 23 are led into the back of the wash-house fitting and through apertures 24 and 25 in the trough back extension plate 4 and into the housing 5 before engaging connecting members 26 and 27.

The connecting members are preferably engaged into the outlet from the trough. Thus the pipe 23 by means of the connecting member 27 discharges water directly into the waste trap 28 but the pipe 22 preferably discharges to a directional valve such that by operating the valve the soapy water can be directed either into the trough 3 or into the waste trap 28. The valve is preferably a plug 29 positionable in the trough outlet at a position below the inlet point from the connecting member 26. Thus, if the member 29 is in position the soapy water will be directed into the trough 3 and if the plug 29 is not in position the soapy water will by the action of gravity be drawn into the waste trap 28.

The use of the invention is as follows:

The wash-house fitting including the trough and the washing machine are installed in a laundry where their matching appearance gives a high aesthetic appeal. The hot and cold water supply connections are engaged such that hot and cold water can be supplied both to the trough 3 and to the washing machine 2.

After the washing cycle has occurred soapy water is pumped through pipe 22 into the trough 3, through an aperture in the base or walls thereof, assuming that the plug 29 has been positioned in the trough 3. After the rinsing cycle has occurred the rinsed water is pumped into the waste trap 28 through the pipe 23.

The soapy water then held in the trough 3 can then be pumped back to the washing machine through the pipe 22 for a further washing cycle.

This process continues until either the soapy water is no longer capable of performing a satisfactory washing function or until washing has been completed where upon by removal of plug 29 the soapy water can be directed to the waste 28.

Thus it can be seen that a wash-house fitting including a trough and a washing machine in combination are provided in which the soapy water can be discharged or held as desired and in which the rinsed water can be discharged while the soapy water is retained.

It is also a particular advantage of the invention that the piping to enable the discharge and retention of the soapy water is substantially hidden from view by being positioned within the housing at the back of the trough. This also allows the soapy water pipe to be raised above the water level in the washing machine and/or trough which is a frequent requirement by washing machines of this type. Thus, pipes do not extend over the lip of the trough thus presenting in the present invention and enhanced aesthetic appeal.

The wash-house fitting and washing appliance such as a washing machine also form a substantially integrated laundry set including a trough the internal capacity of which is unobstructed by pipes, hoses or the like encumbrances.

Also the water can be discharged leaving full use of the trough or alternatively the trough can be used to hold preferably the soapy water.

I claim:

1. A wash-house fitting including a trough able to be combined with a washing appliance, the trough having wall means bounding a space for holding liquid and also having a drainage aperture formed in said wall means and provided with a drainage pipe, first and second conduits extending from said washing appliance and connected to said drainage pipe at first and second positions respectively, said first position being above said second position, and a directional flow control member positionable in said drainage pipe between said first and second positions and having a first condition in which it substantially blocks downward flow of liquid from said first position past said second position while permitting liquid to flow from said first position into the trough, and a second condition in which it permits downward flow of liquid from said first position past said second position, whereby a first liquid initially in said washing appliance can be passed through said first conduit to said drainage pipe and then to waste if said directional flow control member is in its second condition but to said trough when said member is in its first position for later return to said washing appliance through said first conduit, and a second liquid may be transferred from said washing appliance to waste through said second conduit and said drainage pipe.

2. A wash-house fitting including a trough as claimed in claim 1 wherein said first liquid comprises soapy water used for washing articles or the like within said washing appliance and said second liquid comprises rinse water for rinsing articles or the like within said washing appliance, said soapy water being retained in the trough, when said directional flow control member is in its first condition, for re-use in said washing appliance and said second liquid being discharged to waste through said drainage fitting.

3. A wash-house fitting including a trough as claimed in claim 1 wherein said conduits do not pass over the lip or rim of said trough but are substantially concealed as an integral plumbing system.

4. A wash-house fitting including a trough as claimed in claim 1 wherein said wash-house fitting is colored and shaped so as to match the color and shape of said washing appliance.

5. A wash-house fitting including a trough as claimed in claim 1 wherein said wash-house fitting and washing appliance when in combination form a substantially integrated laundry set including a trough, the internal capacity of which is un-obstructed by pipes, hoses or like encumbrances.

6. A wash-house fitting including a trough as claimed in claim 5 wherein said integrated laundry set is capable of discharging all washing liquid while leaving full use of the trough for other purposes or alternatively to hold one liquid for subsequent return to the washing appliance.

* * * * *